US008087472B2

(12) United States Patent
Usselman et al.

(10) Patent No.: US 8,087,472 B2
(45) Date of Patent: Jan. 3, 2012

(54) VIBRATION DAMPENING SYSTEM FOR A POWER TOOL AND IN PARTICULAR FOR A POWERED HAMMER

(75) Inventors: Robert Alan Usselman, Forest Hill, MD (US); Benjamin Schmidt, Hofheim (DE)

(73) Assignee: Black & Decker Inc., Newark, DE (US)

( * ) Notice: Subject to any disclaimer, the term of this patent is extended or adjusted under 35 U.S.C. 154(b) by 223 days.

(21) Appl. No.: 12/533,280

(22) Filed: Jul. 31, 2009

(65) Prior Publication Data

US 2011/0024144 A1 Feb. 3, 2011

(51) Int. Cl.
*B25D 11/04* (2006.01)

(52) U.S. Cl. ..... 173/1; 173/2; 173/201; 173/210; 173/217

(58) Field of Classification Search ..... 173/1, 2, 173/48, 201, 210, 212, 109, 211, 176, 217, 173/162.1
See application file for complete search history.

(56) References Cited

U.S. PATENT DOCUMENTS

| | | | | |
|---|---|---|---|---|
| 4,986,369 | A * | 1/1991 | Fushiya et al. | 173/178 |
| 5,289,885 | A * | 3/1994 | Sakoh | 173/2 |
| 6,015,017 | A * | 1/2000 | Lauterwald | 173/48 |
| 6,371,218 | B1 * | 4/2002 | Amano et al. | 173/183 |
| 6,508,313 | B1 * | 1/2003 | Carney et al. | 173/1 |
| 6,687,567 | B2 * | 2/2004 | Watanabe | 700/168 |
| 6,854,529 | B2 * | 2/2005 | Kuntze et al. | 173/1 |
| 7,036,605 | B2 * | 5/2006 | Suzuki et al. | 173/20 |
| 7,036,703 | B2 * | 5/2006 | Grazioli et al. | 227/10 |
| 7,428,934 | B2 * | 9/2008 | Arimura | 173/181 |
| 7,506,694 | B2 * | 3/2009 | Stirm et al. | 173/178 |
| 7,708,083 | B2 * | 5/2010 | Dresig et al. | 173/2 |
| 2008/0196915 | A1 | 8/2008 | Strim et al. | |

FOREIGN PATENT DOCUMENTS

| | | |
|---|---|---|
| EP | 1252976 | 10/2002 |
| EP | 1502710 | 2/2005 |
| EP | 1607186 | 12/2005 |
| EP | 1870209 | 12/2007 |

* cited by examiner

*Primary Examiner* — Scott A. Smith
(74) *Attorney, Agent, or Firm* — Kofi Schulterbrandt; Scott B. Markow; Adan Ayala

(57) ABSTRACT

The present invention relates to a method for controlling a power tool comprising a housing, an electric motor, a tool holder for supporting a tool bit and a conversion mechanism for converting the rotational movement of the output shaft of the motor into a reciprocating movement of the tool bit when being supporting in the tool holder, wherein oscillations of an element of the power tool are detected, wherein a quantity characterizing the oscillations is monitored and wherein the rotational speed of the electric motor is controlled such that the quantity does not exceed a preset value.

17 Claims, 4 Drawing Sheets

VIBRATION DAMPENING SYSTEM FOR A POWER TOOL AND IN PARTICULAR FOR A POWERED HAMMER

FIELD OF THE INVENTION

The present invention relates to a power tool comprising a housing, an electric motor, a tool holder for supporting a tool bit and a conversion mechanism for converting the rotational movement of the output shaft of the motor into a reciprocating movement of the tool bit when being supporting in the tool holder, and to a method for controlling such power tool.

BACKGROUND OF THE INVENTION

In particular in power tools comprising a reciprocatingly driven tool bit the problem arises that vibrations generated by the drive mechanism for the tool bit are transferred to the user who is operating the tool. Since operating a vibrating power tool is considered uncomfortable and may have negative effects on the health of the user, there is a growing need to reduce the vibrations applied to a user during use of such power tool.

In a powered hammer the hammer mechanism usually comprises a hollow spindle or cylinder in which a ram is slidably arranged and a tool holder disposed at the front end of the spindle for supporting a tool bit, the bit being capable of sliding to a limited extend along an axis being parallel to the spindle axis. Further, a piston is guided within the spindle or cylinder wherein an air cushion is provided between the piston and the ram. The piston is coupled to a crank drive so that a rotational movement of a drive motor shaft of the hammer is converted into a reciprocating movement of the piston. This movement in turn is transferred to the ram via the air cushion, the ram hitting either directly a tool bit supported by the tool holder or a beat piece arranged between the ram and the tool bit wherein in both cases the momentum of the ram is transferred to the tool bit.

During normal use of a powered hammer, when the drive motor is activated and the ram applies impacts on the tool bit, vibrations of the entire hammer are generated wherein these vibrations are felt by the user carrying the hammer. If the amplitude of these vibrations exceeds certain thresholds, this may cause serious damages to the user's health in case the hammer is used over a sufficiently long period. In particular, problems may occur in the region of the user's hands, arms and shoulders.

As a result the legal stipulations regarding vibrations of tools to which employees are subjected, have recently been tightened. In particular, the threshold values for vibrations above which the health conditions of an employee have to be monitored in case the employee is subjected to these vibrations have been reduced significantly. Therefore, it is required that power tools are adapted to comply with these new rules in order to avoid additional efforts for the employer. In particular, the amplitude of the vibrations occurring at the handle portions should be minimized.

To this end as a counter measure against vibrations, it is known from the prior art to employ an oscillating counter mass in the hammer. Here, EP 1 252 976 A1 discloses to provide a slidable counter mass in the tool housing, the mass being supported by a spring assembly and being slidable along a direction which is parallel to the moving direction of the ram. This spring-mass-assembly has a resonance frequency which is mainly determined by the spring stiffness, the weight of the counter mass and the dampening effect due to friction.

Due to the vibrations generated by the hammer mechanism, oscillations of the mass are induced wherein these vibrations have a frequency which is equal to the frequency with which the ram applies impacts on the beat piece and the tool bit, respectively. Thus, the vibration frequency is determined by the rotational speed of the drive motor.

If the vibration frequency, i.e. the frequency with which the spring-mass-assembly is excited, is below the resonance frequency of the spring-mass-assembly, the mass oscillates in anti-phase with the ram. This leads to a reduction of the overall vibrations of the tool housing wherein the system is most efficient if the vibration frequency is close to but below the resonance frequency, since then the amplitude with which the counter mass oscillates is maximized.

However, here the following problem occurs. If the vibration frequency exceeds the resonance frequency of the spring-mass-assembly, the mass oscillates in parallel with the ram rather than being in anti-phase, which has the negative effect that the vibrations of the entire tool are enhanced rather than being reduced.

Therefore, it has to be ensured that the resonance frequency of the mass spring system is above the vibration frequency. In this connection, tolerances have to be taken into account that occur during production of the springs of the spring-mass-assembly.

In order to ensure that the aforementioned requirement for the resonance frequency is fulfilled independent of the tolerances of the springs, the design of the spring-mass-assembly is chosen such that the calculated value of the resonance frequency of the system is well above the vibration frequency which is determined by the rotational speed of the electric motor. However, this results in a vibration dampening effect which is less compared to the case in which the vibration frequency nearly reaches the resonance frequency and the oscillation amplitude of the counter mass reaches a maximum value at which the windings of the springs do not get into contact with each other.

BRIEF SUMMARY OF THE INVENTION

Therefore, it is the object of the present invention to provide a power tool and a method for controlling such tool which allow to improve the vibration dampening so that the vibrations felt by a user are reduced.

In addition, it is a further object to increase the efficiency with which vibrations are reduced in a power tool, in particular a powered hammer, by means of a mass spring system.

This object is achieved by a method for controlling a power tool comprising a housing, an electric motor, a tool holder for supporting a tool bit and a conversion mechanism for converting the rotational movement of the output shaft of the motor into a reciprocating movement of the tool bit when being supporting in the tool holder, wherein oscillations of an element of the power tool are detected, wherein a quantity characterizing the oscillations is monitored and wherein the rotational speed of the electric motor is controlled such that the quantity does not exceed a preset value.

The method according to the present invention allows to reduce the effect of the vibrations which are originally generated by the operation of the drive motor. In particular, the element which is gripped by a user and which is vibrating, usually has a well defined resonance frequency, and the smaller the difference between this resonance frequency and the frequency is with which vibrations are generated by the drive motor, the higher is the amplitude of the vibrations of the element in question and, thus, the effect on the user. Hence, by monitoring the vibrations of the element and by adjusting the rotational speed of the motor, i.e. the excitation frequency for the element in question it is possible to limit the strength of the vibrations felt by a user.

In case of a powered hammer comprising a hammer mechanism including a ram which reciprocates along a moving axis and applies impacts on the tool bit when being supported in the tool holder the method of the present invention allows to minimize the vibrations generated by the hammer mechanism. In particular in hammers having a counter mass system wherein a quantity of motion of the oscillations with which the counter mass oscillates, is determined, the method has proven to be beneficial.

In the prior art powered hammers the rotational speed of the drive motor for the hammer mechanism and hence the vibration frequency were fixed and the dimensions of the spring-mass-assembly had to be adjusted accordingly to avoid that the resonance frequency of the spring-mass-system is below the vibration frequency. According to the present invention the amplitude with which the counter mass oscillates around the neutral position, may be detected and the rotational speed of the motor is controlled so that this amplitude assumes a preset value and does not exceed this value. However, other quantities of motion characterizing the oscillations of the counter mass assembly may also be monitored.

By controlling the motor speed in such a manner, it is avoided that the vibration frequency reaches a value which is above the resonance frequency of the spring-mass-assembly. When the motor is operating and the counter mass starts to oscillate the oscillation amplitude will increase. If the amplitude exceeds the preset value the motor speed will be reduced until the amplitude is below that threshold.

Moreover, the oscillation amplitude will increase significantly when the vibration frequency approaches the resonance frequency of the spring-mass-system. Therefore, by choosing a preset value for the amplitude the motor cannot reach a rotational speed which leads to a vibration frequency which is too close or above the resonance frequency.

Different from the prior art, the dimensions of the spring-mass-assembly are not as crucial anymore since the counter mass is prevented from oscillating with an amplitude above a threshold independent of its actual mass or of the actual stiffness of the springs in the system.

Therefore, the preset value for the amplitude may be chosen such that a maximum vibration dampening is achieved without the risk that the vibration frequency exceeds the resonance frequency which would lead to an enhancement of the overall vibrations of the tool housing.

Furthermore, it is preferred that the hammer comprises a coil surrounding the path along which the counter mass oscillates, the counter mass being formed of a metal, wherein for determining the oscillation amplitude the inductance of the coil is monitored as a function of time. Here, the variation of the inductance of the coil due to the counter mass passing through the coil depends on the amplitude with which the counter mass oscillates. Thus, the signal generated by the varying inductance may directly be used as an input signal when controlling the rotational speed of the motor. In particular, it is preferred that the hammer comprises first and second coils being symmetrically arranged with respect to the neutral position of the counter mass wherein the oscillation amplitude or another quantity of motion is determined via simultaneously monitoring the inductance of the first and second coils.

As an alternative to the use of induction coils, it is also possible to employ hall sensors for detecting the amplitude with which the counter mass oscillates, or another quantity of motion. In particular, in one embodiment a single Hall sensor may be positioned adjacent to the neutral position of the counter mass, wherein the counter mass comprises a magnet element and the oscillation is monitored via detecting the duration of the time interval in which the magnet affects the Hall sensor.

Here, it is employed that a commonly used Hall sensor outputs a 5V-signal if the magnet does not affect the sensor whereas the output is a OV-signal if the magnet on the counter mass is within the region of the sensor.

Moreover, the time duration in which the magnet influences the sensor, depends on the velocity of the counter mass, and the higher the velocity is the larger is the amplitude with which the counter mass oscillates. Thus, from the duration of the time interval in which the Hall sensor outputs a signal indicating that the magnet is in the region of the sensor, the oscillation amplitude or other quantities of motion can be calculated.

In another embodiment the hammer comprises a plurality of Hall sensors being arranged adjacent to the path along which the counter mass oscillates, the distance the sensors have to the neutral position differing for each sensor. In addition, the counter mass comprises a magnet element, and the oscillation amplitude is determined via monitoring which Hall sensors are affected by the magnet located on the counter mass.

The latter method allows for a direct detection of the oscillation amplitude of the counter mass. However, this technique requires a more complicated design, since a plurality of sensors is required.

Furthermore, the above object is achieved by a power tool comprising a housing, an electric motor, a tool holder for supporting a tool bit and a conversion mechanism for converting the rotational movement of the output shaft of the motor into a reciprocating movement of the tool bit when being supporting in the tool holder, a detection device for detecting oscillations of an element of the tool wherein the device outputs a signal characterizing the oscillations, and a control unit coupled with the electric motor and the detection device, the unit being adapted such that the rotational speed of the electric motor is controlled so that a quantity characterizing the oscillations and determined based on the signal does not exceed a preset value.

With a power tool having the afore-mentioned features the same effects may be achieved which have been discussed with respect to the method according to the invention. The same applies to the preferred embodiments of the present power tool.

BRIEF DESCRIPTION OF THE DRAWINGS

In the following two embodiments of a power tool, i.e. a powered hammer, according to the present invention will be described by way of example with reference to the accompanying drawings in which.

DETAILED DESCRIPTION OF THE INVENTION

Firstly, the following should be noted. Although the principles of the present invention are discussed with respect to embodiments of powered hammers, the invention is not limited to the application to such hammers. It is also possible to employ the afore-mentioned concepts in other power tools having reciprocatingly driven tool bits e.g. jig saws, saber saws or the like.

Figure 1:
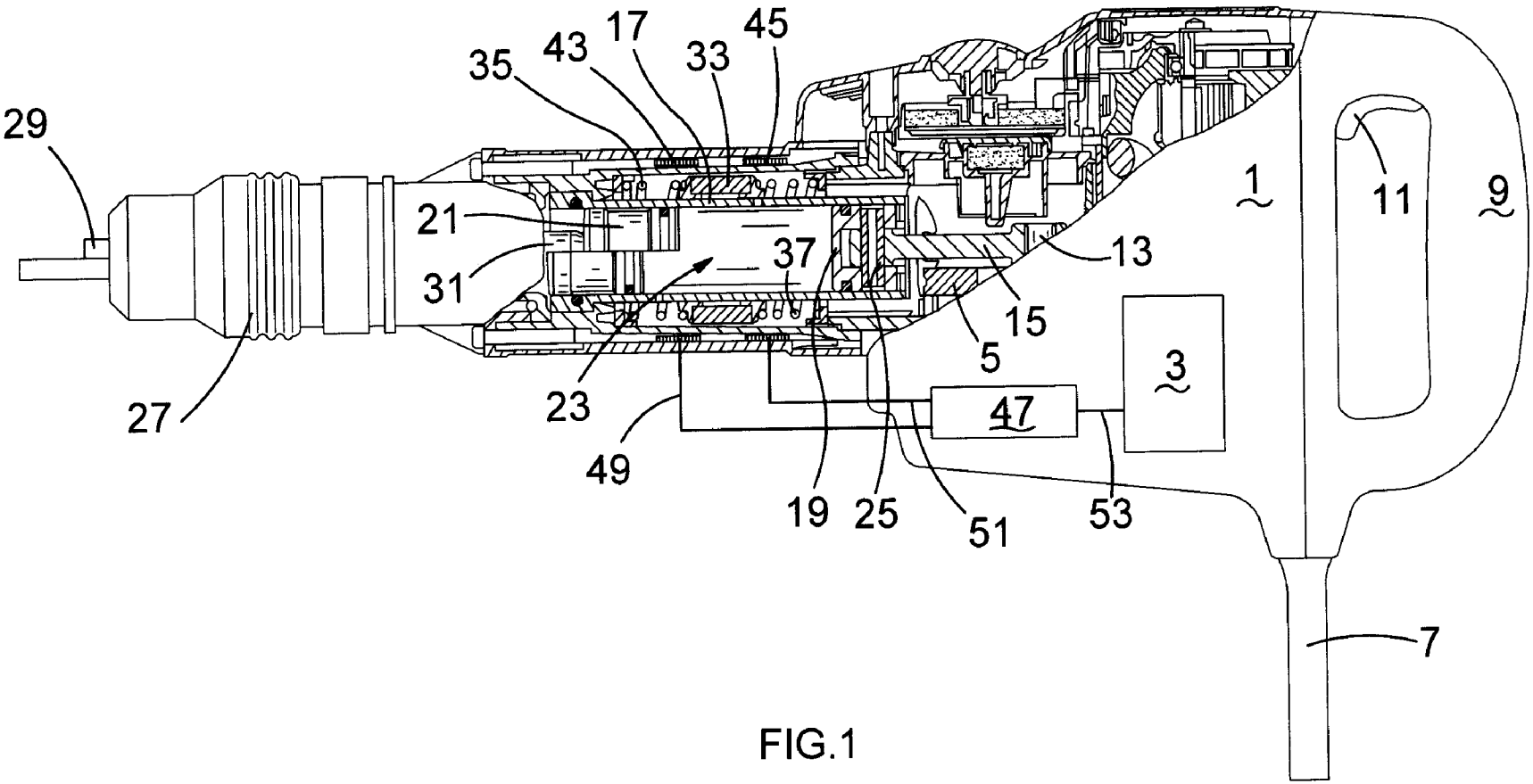
FIG. 1 shows a partially cutaway longitudinal cross section through a demolition hammer.

As shown in FIG. 1, a hammer according to the present invention comprises a housing 1, which contains an electric motor 3 the output shaft of which is coupled with a crank plate 5 via a gear set (not shown). Further, a cable 7 is coupled to the electric motor 3 to connect it with a mains power supply. However, it is also conceivable that the hammer is battery powered. Moreover, in the rear section of the housing 1 a handle portion 9 is provided which comprises a trigger switch 11 by means of which the electric motor 3 may be activated by a user.

The crank plate 5 is rotationally driven by the rotating output shaft of the electric motor 3 and comprises a crank pin 13 which is radially offset from the center of the crank plate 5. The crank pin 13 is pivotably received in a bore at the rear end of a crank arm 15 so that the latter may pivot with respect to the crank plate 5.

In the front section of the tool housing 1 a cylindrical hollow spindle 17 is positioned in the rear part of which a piston 19 is slidably arranged. In the front portion of the spindle 17 a slidable ram 21 is positioned, and the periphery of both the piston 19 and the ram 21 is in sealing contact with the inner surface of the spindle 17 so that a sealed air cushion 23 is formed between the piston 19 and the ram 21. Thus, a movement of the piston 19 along the spindle axis results in a corresponding movement of the ram 21.

The rear end of the piston 19 is pivotably coupled with the front end of the crank arm 15 via a trunnion pin 25 which is received in a corresponding bore in the piston 19. Thus, the crank plate 5, the crank pin 13, the crank arm 15 and the trunnion pin 25 form a conventional crank drive mechanism for the piston 19, and a rotational movement of the output shaft of the motor 3 and the crank plate 5 is converted into a reciprocating movement of the piston 19. Thus, the crank drive mechanism is effective as a conversion mechanism.

Although in this preferred embodiment a crank drive mechanism is employed to convert the rotational output of the drive motor 3 into a reciprocating movement, it is also conceivable that a wobble drive mechanism is rather used for this purpose.

At the front end of the spindle 17 the hammer comprises a tool holder 27 for supporting a tool bit 29 which in case of a demolition hammer is usually a chisel bit. The tool bit 29 is supported in the tool holder 27 in such a manner that it is capable of conducting a limited reciprocating movement in the axial direction of the spindle 17. Moreover, the tool holder 27 is designed such that the rear end of a tool bit 29 when being received in the tool holder 29 may be contacted by a beat piece 31 which is arranged inside the spindle 17 in front of the ram 21. Thus, when the ram 21 is forced to move in forward direction towards the front end of the spindle 17 via the air cushion 23 between the piston 19 and the ram 21, the ram 21 hits the beat piece 31 which in turn applies impacts on the rear end of the tool bit 29 so that it moves forwardly in the tool holder 27.

Accordingly, the hammer mechanism comprises the crank drive mechanism as well as the spindle 17, the piston 19, the ram 21, the beat piece 31 and the tool holder 27 to apply impacts on the tool bit 29 when being received in the tool holder 27. These impacts result in vibrations of the entire housing 1 wherein the vibration frequency corresponds to the frequency with which the beat piece 31 applies impacts on the tool bit 29 and thus is determined by the rotational speed of the output shaft of the electric motor 3.

For dampening these vibrations, the hammer comprises a counter mass 33 which is movably supported in the housing 1 and may slide parallel to the longitudinal axis of the hollow spindle 17 and hence, parallel to the moving axis of the ram 21. In particular, the counter mass 33 is ring-shaped and surrounds the spindle 17. In addition, the counter mass 33 is supported between first and second helical springs 35, 37, the ends of which opposite the counter mass 33 abut on ring shaped stop elements 39, 41 adjacent the front end and the rear end of the spindle 17, respectively. Usually the springs 35, 37 have the same dimensions and in particular the same stiffness, and thus, the springs 35, 37 bias the counter mass 33 towards a neutral position centered between the stop elements 39, 41.

When the motor 3 is rotating and the ram 21 is applying impacts on a tool bit 29 via the beat piece 31, the resulting vibrations excite the spring-mass-assembly comprising the counter mass 33 and the springs 35, 37 wherein the counter mass 33 oscillates in anti-phase with respect to the reciprocating movement of the ram 21 provided the vibration frequency, i.e. excitation frequency, is below the resonance frequency of the spring-mass-assembly, this resonance frequency being defined inter alia by the weight of the counter mass 33 and the length and stiffness of the springs 35, 37. The oscillating counter mass 33 has the effect that the vibrations of the entire housing 1 are reduced wherein the reduction depends on the amplitude of the counter mass oscillations.

Moreover, the closer the vibration frequency is to the resonance frequency of the spring-mass-assembly, the higher is the amplitude with which the counter mass 33 oscillates and thus the dampening effect for the vibrations of the housing 1.

However, if the vibration frequency which is determined by the rotational speed of the electric motor 3, is even slightly above the resonance frequency of the spring-mass-assembly, the counter mass 33 oscillates in parallel with the ram 21, and hence, the dampening effect no longer occurs. Instead, the vibrations of the housing 1 are even enhanced compared to the situation without a counter mass.

In order to avoid this situation, in the first embodiment according to the present invention the hammer is provided with a first induction coil 43 and a second induction coil 45 surrounding the path along which the counter mass 33 travels, and being symmetrically arranged with respect to the neutral position of the counter mass 33, i.e. the distance the coils 43, 45 have to the neutral position of the counter mass 33 when being measured in the axial direction of the spindle 17, is the same for both coils 43, 45. Thus, these coils 43, 45 are effective as a detection device for determining the oscillation amplitude with which the counter mass 33 oscillates.

Furthermore, the counter mass 33 is formed of a metal so that the counter mass 33 when entering the regions of its path which are surrounded by the coils 43, 45, alters the inductance of the coils 43, 45. In particular the higher the degree is with which the counter mass 33 enters the region surrounded by a coil 43, 45 the larger is the increase of the inductance of the respective coil 43, 45, since this coil has an "iron core" at that point in time. Thus, if the inductance of the coils 43, 45 is measured as a function of time, the resulting signal reflects the deflection of the counter mass 33 from its neutral position, and it is possible to derive for example the amplitude with which the counter mass 33 oscillates.

Figure 2:
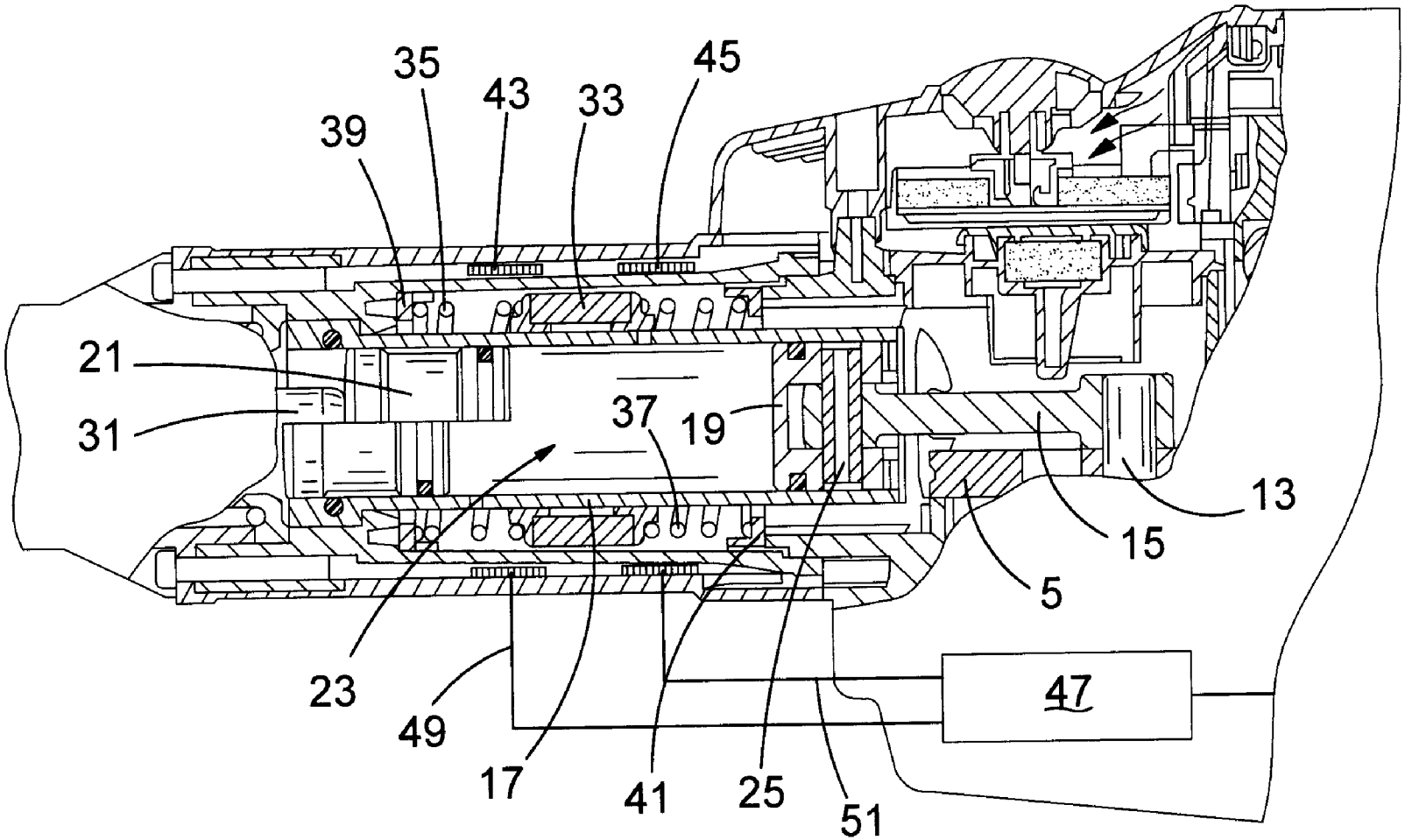
FIG. 2 shows a partially cutaway longitudinal cross section of the hammer mechanism of the demolition hammer shown in FIG. 1.

For measuring these alterations of the inductance the coils 43, 45 are connected with a micro controller 47 as indicated by lines 49, 51, the controller functioning as a control unit and being provided in the tool housing 1 as schematically shown in FIGS. 1 and 2. The micro controller 47 in turn is connected with the electric motor 3 via line 53, so that the micro controller 47 may adjust the rotational speed of the motor 3 depending on the signals which are provided by the induction coils 43, 45.

Figure 3:
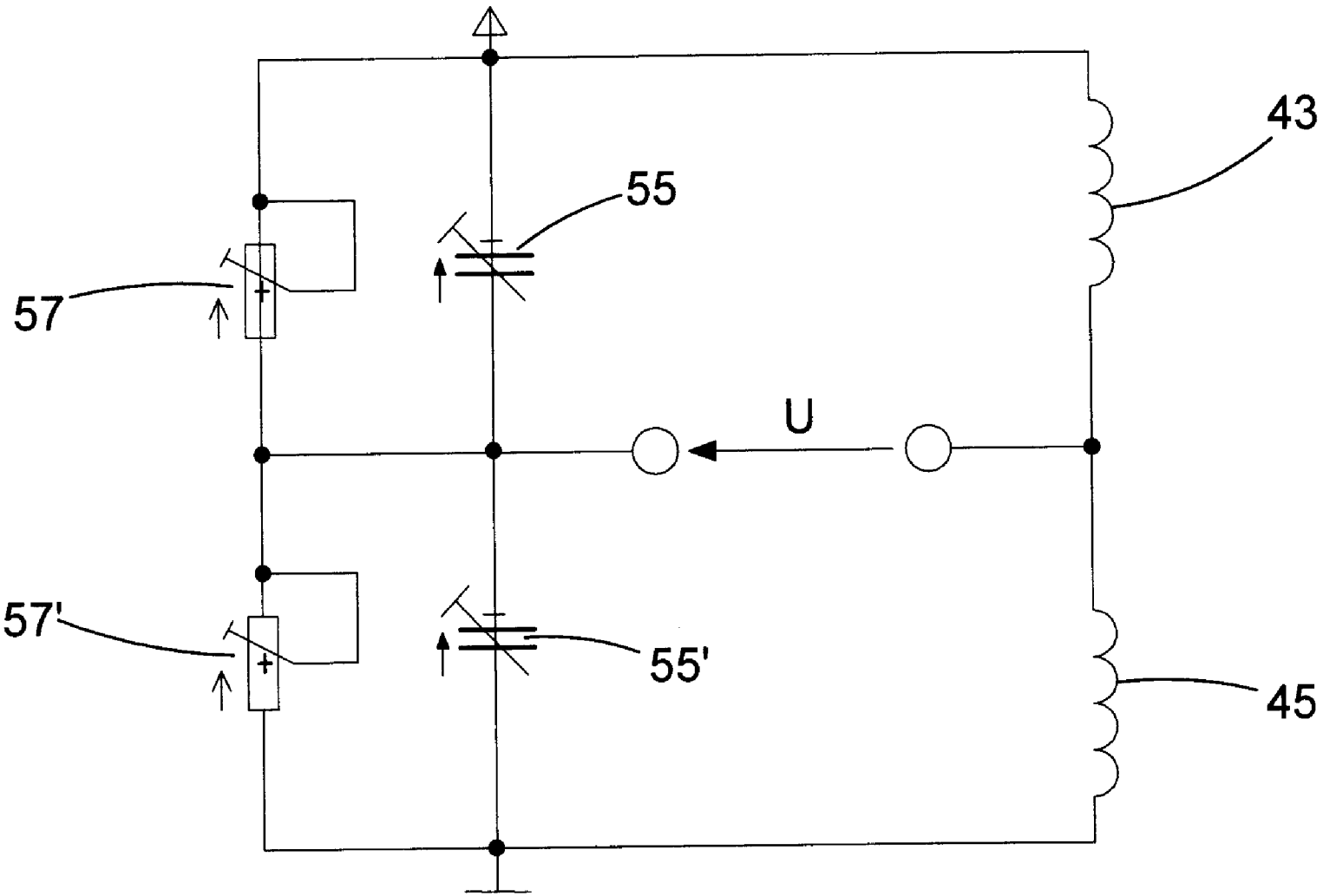
FIG. 3 shows a circuit diagram of the bridge circuit employed in the embodiment shown in FIGS. 1 and 2.

In particular, in the preferred embodiment described here, both coils 43, 45 are interconnected via a bridge circuit shown in FIG. 3 so that the inductance of the coils 43, 45 is simultaneously monitored and an output voltage U of this circuit is directly proportional to the distance of the actual position of the counter mass 33 from its neutral position.

The capacitors 55, 55' and the potentiometers 57, 57' in the bridge circuit are used to balance the circuit so that the output voltage U is zero when the counter mass 33 is in the neutral position.

The voltage output signal U is used as an input for the micro controller 47 wherein an analog-digital-converter is employed to provide an appropriate input signal fed to the controller 47. The micro controller 47 then outputs a corresponding signal to control the rotational speed of the electric motor 3.

Thus, when the electric motor 3 is activated, the oscillation amplitude is determined with which the counter mass 33 oscillates via the coils 43, 45, wherein the rotational speed of the electric motor 3 is controlled by the micro controller 47 being effective as a control unit in the sense of the present invention such that the oscillation amplitude assumes a preset value and this value is not exceeded. The preset value set in micro controller 47, is chosen such that the dampening effect due to the counter mass 33 suffices to reduce the vibrations of the entire housing 1 to an acceptable level.

If during operation of the hammer the actual amplitude with which the counter mass 33 oscillates exceeds the preset value this is an indication that the vibration frequency, i.e. the frequency with which the spring-mass-assembly is excited, is approaching the resonance frequency of this system which means that there is the risk, that the resonance frequency is exceeded with the effect that the counter mass 33 then oscillates in parallel with the ram 21 and no vibration dampening effect is achieved. Therefore, in the hammer according to the present invention the rotational speed of the electric motor 3 is reduced by the micro controller 47, so that the oscillation amplitude decreases.

Thus, as the oscillation amplitude of the counter mass 33 is monitored and the rotational speed of the drive motor 3 is adjusted correspondingly, in the inventive hammer the efficiency for dampening vibrations does not depend on the accuracy with which the spring-mass-assembly has been produced. Instead, an optimization of the dampening effect of the oscillating counter mass 33 is achieved.

Figure 4:
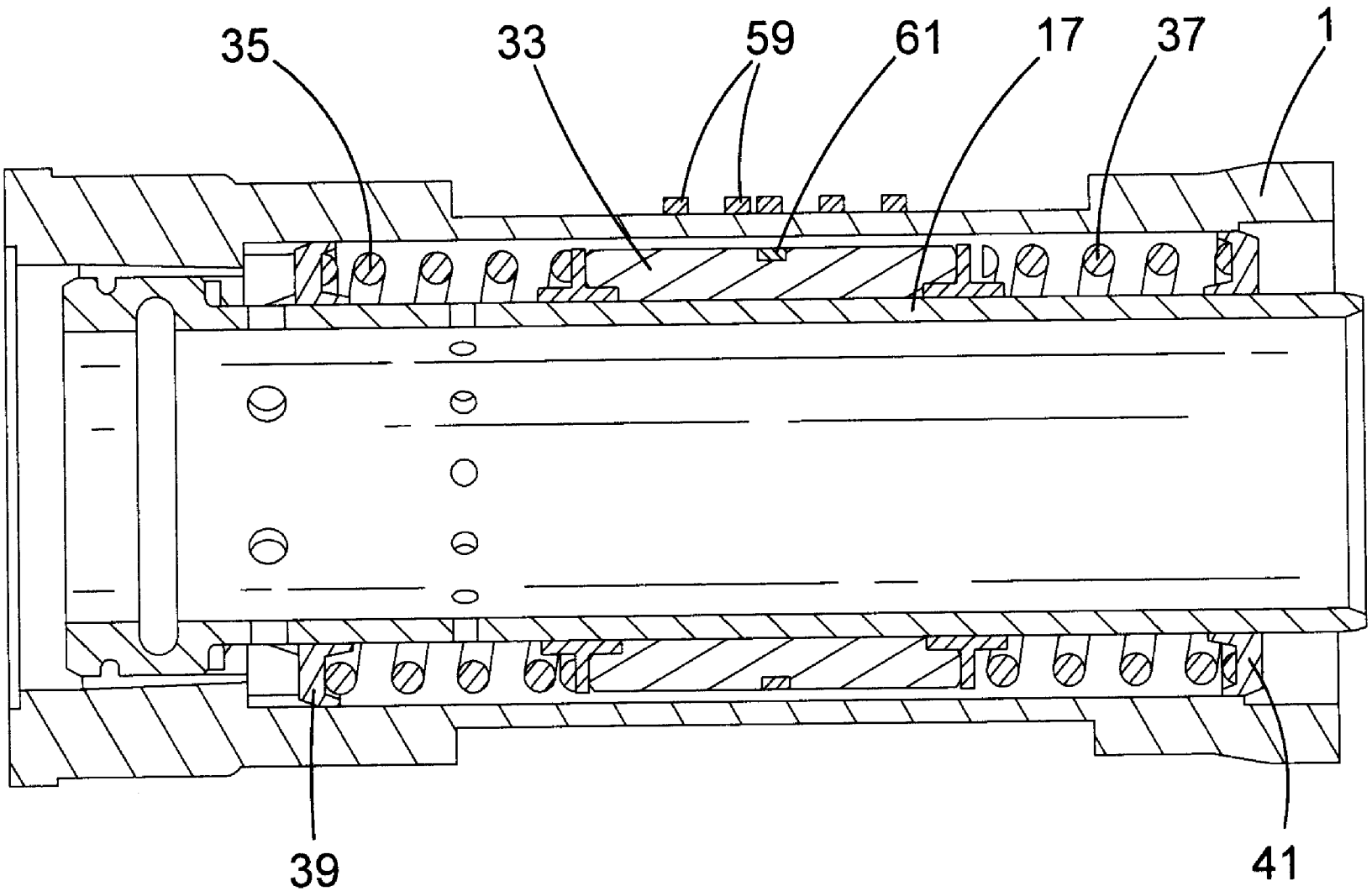
FIG. 4 shows a longitudinal cross section of the region of the spindle of a second embodiment of a demolition hammer according to the present invention.

FIG. 4 shows the longitudinal cross section of the region of the spindle 17 of a second embodiment of a demolition hammer according to the present invention. In this embodiment a plurality of Hall sensors 59 is mounted in the tool housing 1 wherein the distance the sensors 59 have to the neutral position of the counter mass 33, differs for each sensor 55. Furthermore, a magnet 61 is mounted on the counter mass 33 the magnet 61 affecting one of the Hall sensors 59 depending on the distance the counter mass 33 has from its neutral position. The Hall sensors 59 output a different signal if the magnet 61 is located adjacent to the respective Hall sensor 59 so that the amplitude with which the counter mass 33 oscillates, can be derived from the indication which Hall sensors 59 are affected by the magnet 61. When even the sensors 59 having a large distance to the neutral position of the counter mass 33 output a signal indicating that the magnet 61 has passed these sensors 59, the oscillation amplitude is high compared to the case where only the sensors 59 close to the neutral position intermittently output a modified signal.

In this embodiment, each Hall sensor 59 is connected to the micro controller 47 which is adapted to evaluate the output of the respective Hall sensors 59 and determine whether the oscillation amplitude is below the preset amplitude value or exceeds it. Based on this result the electric motor 3 is controlled in the same manner as described in connection with the first embodiment. Therefore, this embodiment also allows to control the rotational speed of the electric motor 3 depending on the amplitude with which the counter mass 33 oscillates wherein the fact that the exact value of the resonance frequency of the spring-mass-assembly is not precisely known, does not influence the efficiency with which the vibrations of the housing 1 are dampened.

In the embodiments shown in the accompanying figures the deflection of the counter mass 33 with respect to neutral position is monitored via the detection device which includes at least two sensor elements, and based on a respective signal the amplitude with which the counter mass 33 oscillates, is determined. However, it also possible to employ merely a single sensor element adjacent to the neutral position of the counter mass 33. Then the duration of the time interval is detected during which the sensor element is affected by the passing counter mass 33, wherein this duration is a measure for the velocity of the counter mass 33 at the neutral position. Since the velocity at the neutral position, and the oscillation amplitude are directly related, it is possible to determine the amplitude. Therefore, a signal representing this duration may also be employed as a signal on the basis of which the rotational speed of the electric motor 3 is controlled.

Thus, it is also possible that instead of using a plurality of Hall sensors 59 a single Hall sensor is arranged adjacent to the neutral position of the counter mass 33, and the micro controller 47 monitors the duration of the time interval in which the Hall sensor outputs a signal indicating that the counter mass 33 with the magnet 57 is in the region of the sensor.

In the same way, a single coil may be arranged in such a way it surrounds the path of the counter mass 33 in the region of the neutral position, and the duration of an alteration of the inductance of the coil as a result of the passing counter mass 33 is monitored.

Finally, although in the afore-mentioned embodiments the amplitude of the oscillations of an element of the hammer has been monitored, it is also possible to detect a different quantity of motion of the oscillating element of the power tool such as the velocity or the acceleration as a function of time and to define a corresponding preset value as a threshold.

As apparent from the above description a power tool according to the present invention allows for a more effective dampening of vibrations of the tool housing, since the value of the amplitude with which an element, i.e. the counter mass 33, oscillates may be chosen such that a sufficient dampening effect is achieved without the risk that the excitation frequency for the spring-mass-assembly, i.e. the vibration frequency, exceeds the resonance frequency of the assembly which would result in a pure dampening effect.

The invention claimed is:

1. A method of controlling a power tool comprising:

a housing, an electric motor, a tool holder for supporting a tool bit and a conversion mechanism for converting the rotational movement of the output shaft of the motor into a reciprocating movement of the tool bit when being supporting in the tool holder, wherein oscillations of an element of the power tool are detected, wherein a quantity characterizing the oscillations is monitored and wherein the rotational speed of the electric motor is controlled such that the quantity does not exceed a preset value.

2. The method according to claim 1, wherein the power tool is a powered hammer comprising a hammer mechanism including a ram which reciprocates along a moving axis and applies impacts on the tool bit when being supported in the tool holder, the hammer mechanism being operatively coupled to the electric motor via the conversion mechanism.

3. The method according to claim 2, further providing a counter mass movably supported in the housing, the counter mass being biased towards a neutral position by at least one spring element and being capable of oscillating around the neutral position in a direction which is parallel to the moving axis of the ram, and wherein a quantity of motion of the oscillations with which the counter mass oscillates is determined when the electric motor is activated, and wherein the rotational speed of the electric motor is controlled such that the quantity of motion assumes a preset value.

4. The method according to claim 3, wherein an amplitude of the oscillations with which the counter mass oscillates, is determined when the electric motor is activated and wherein the rotational speed of the electric motor is controlled such that the oscillation amplitude assumes a preset value.

5. The method according to claim 3, wherein the hammer further comprises a coil surrounding the path along which the counter mass oscillates, wherein the counter mass is formed of a metal, and wherein the inductance of the coil is monitored as a function of time for determining the quantity of motion.

6. The method according to claim 5, wherein the hammer comprises first and second coils being symmetrically arranged with respect to the neutral position of the counter mass and wherein the quantity of motion is determined via simultaneously monitoring the inductance of the first and second coils.

7. The method according to claim 5, wherein the quantity of motion being determined is the amplitude of the oscillations with which the counter mass oscillates.

8. The method according to claim 3, wherein the hammer further comprises a Hall sensor being positioned adjacent to the neutral position of the counter mass, wherein the counter mass comprises a magnet element and wherein the quantity of motion is determined via detecting the duration of the time interval in which the magnet affects the Hall sensor.

9. The method according to claim 3, wherein the hammer further comprises a plurality of Hall sensors being arranged adjacent to the path along which the counter mass oscillates, the distance the Hall sensors have to the neutral position differing for each Hail sensor, wherein the counter mass comprises a magnet element and wherein the quantity of motion is determined via monitoring which Hall sensors are affected by the magnet located on the counter mass.

10. A Power tool comprising:

a housing, an electric motor, a tool holder for supporting a tool bit and a conversion mechanism for converting the rotational movement of the output shaft of the motor into a reciprocating movement of the tool bit when being supporting in the tool holder, a detection device for detecting oscillations of an element of the tool wherein the device outputs a signal characterizing the oscillations, and a control unit coupled with the electric motor and the detection device, the unit being adapted such that the rotational speed of the electric motor is controlled so that a quantity characterizing the oscillations and determined based on the signal does not exceed a preset value.

11. The power tool according to claim 10, wherein the too; is a hammer comprising a hammer mechanism including a ram which is reciprocatingly driven along a moving axis to apply impacts on the tool bit when being supported in the tool holder, the hammer mechanism being coupled to the electric motor via the conversion mechanism.

12. The power tool according to claim 11 further comprising a counter mass movably supported in the housing, the counter mass being biased towards a neutral position by at least one spring element and being capable of oscillating around the neutral position in a direction which is parallel to the moving axis of the ram, wherein the control unit is adapted to determine a quantity of motion of the oscillations with which the counter mass oscillates, when the electric motor is activated, and wherein the control unit is adapted such that the rotational speed of the electric motor is controlled so that the quantity of motion does not exceed a preset value.

13. The power tool according to claim 12, wherein the control unit is adapted to determine the amplitude of the oscillations with which the counter mass oscillates, when the electric motor is activated, and wherein the control unit is adapted such that the rotational speed of the electric motor is controlled so that the oscillation amplitude assumes a preset value.

14. The power tool according to claim 12, wherein the detection device comprises a coil surrounding the path along which the counter mass oscillates and wherein the counter mass is formed of a metal.

15. The power tool according to claim 14 wherein the detection device comprises first and second coils being symmetrically arranged with respect to the neutral position of the counter mass.

16. The power tool according to claim 12, wherein the detection device comprises a Hall sensor being arranged adjacent to the neutral position of the counter mass and wherein the counter mass comprises a magnet element.

17. The power tool according to claim 12, wherein the detection device comprises a plurality of Hail sensors being arranged adjacent to the path along which the counter mass reciprocates wherein the counter mass comprises a magnet element and wherein the distance the sensors have to the neutral position differs for each sensor.

* * * * *